United States Patent [19]

Chryssomallis et al.

[11] Patent Number: 4,711,154

[45] Date of Patent: Dec. 8, 1987

[54] COMBUSTION AUGMENTED PLASMA PRESSURE AMPLIFIER

[75] Inventors: George Chryssomallis, Golden Valley; Robert S. Griffing, Andover, both of Minn.

[73] Assignee: FMC Corporation, Chicago, Ill.

[21] Appl. No.: 795,033

[22] Filed: Oct. 31, 1985

[51] Int. Cl.[4] ..... F41F 1/04

[52] U.S. Cl. ..... 89/7; 102/440

[58] Field of Search ..... 89/7, 8; 102/440; 313/138, 566

[56] References Cited

U.S. PATENT DOCUMENTS

| | | | |
|---|---|---|---|
| 3,431,816 | 3/1969 | Dale | 89/08 |
| 3,537,352 | 11/1970 | Joyce | 89/07 |
| 3,665,803 | 5/1972 | Forsten et al. | 89/7 |
| 4,132,149 | 1/1979 | Ashley | 89/1.704 |
| 4,333,125 | 6/1982 | Hensley et al. | 313/138 |
| 4,376,406 | 3/1983 | Black | 89/7 |
| 4,432,933 | 2/1984 | Teitel et al. | 376/152 |
| 4,496,518 | 1/1985 | Marie | 372/106 |
| 4,507,589 | 3/1985 | Prono | 313/231.01 |
| 4,527,389 | 7/1985 | Biddle et al. | 149/45 |

FOREIGN PATENT DOCUMENTS 2742495 4/1979 Fed. Rep. of Germany .

*Primary Examiner*—Stephen C. Bentley
*Assistant Examiner*—Stephen M. Johnson
*Attorney, Agent, or Firm*—Douglas W. Rudy; Richard B. Megley

[57] ABSTRACT

A propulsion device uses an electrically driven plasma injector to feed combustible fuel into a chamber prefilled with an oxidizer. A reaction between the two constituents augments the electrical power input to produce amplified pressure for the acceleration of projectiles.

13 Claims, 1 Drawing Figure

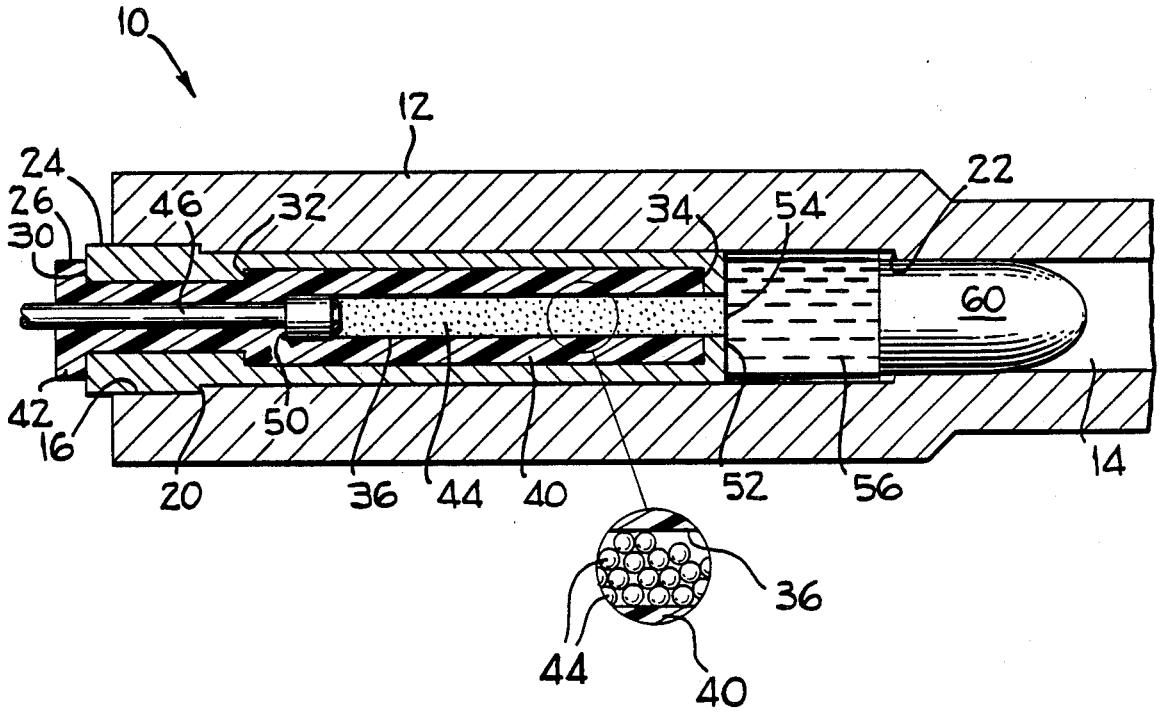
10
12
24
26
30
46
32
34
54
22
60
42
16
50
20
36
44
40
52
56
14
36
44
40

COMBUSTION AUGMENTED PLASMA PRESSURE AMPLIFIER

BACKGROUND OF THE INVENTION

1. Field of the Invention

This invention has to do with an apparatus for the generation of pressure amplification suitable for use in projecting a projectile. A controlled chemical reaction is sustained by precisely controlling the power applied to a fuel delivering plasma generator in communication with a source of oxidizer fluid. Upon reaction of the fuel and the oxidizer, or simply the oxidation of the plasma, pressure in the reaction chamber is dramatically increased resulting in sufficient pressure to power a projectile at significant velocity.

2. Description of the Prior Art

This invention draws from the combined technology of liquid propellant propulsion technology and electrothermal propulsion technology neither of which teach this hybrid combination.

In liquid propellant technology one or more fluids can be combined to generate a chemical reaction that produces pressure to power a projectile. The metering and mixing of the two fluids is difficult to control and therefore is subject to the risk of catastrophic failure or at least erratic performance. Usually mechanical means require seal and metering technology which is unreliable and so expensive as to be unjustifiable in a high production environment.

The electrothermal propulsion system is a new technology that utilizes the electrical output of an inductive or capacitive network which condenses a pulse from an electrical generating source and energizes the cathode of the system. Dielectric breakdown plasma is directed to a chamber containing an inert working fluid which is vaporized to provide gas pressure to eject or propel a projectile. All of the projectile energy is derived from the electrical power pulse. The resulting device has the serious drawback of being extremely bulky due to the excessive size of the electrical power supply which makes the unit difficult to integrate with desirable platforms for use as projectile launchers.

SUMMARY OF THE INVENTION

The propulsion or pressure amplification system disclosed herein is a hybrid unit combining the liquid propellant and the electrothermal technologies resulting in an efficient propulsion unit that has ameliorated the disadvantages of those technologies. The instant invention is a combustion augmented plasma (CAP) device that uses a plasma cartridge to controllably inject fuel into an oxidizer chamber. The plasma cartridge functions as an electric feed pump whose injection rate is controlled by the power applied to the plasma cartridge. The chemical reaction of the oxidizer with fuel supplied by the plasma feed pump provides the principal source of energy for generation or amplification of pressure. The uses of such generated pressure are several such as the production of an impact force or the generation of a controlled pressure increase for use in propelling a projectile.

DESCRIPTION OF THE PREFERRED EMBODIMENT

A preferred embodiment of this invention incorporates the use of the pressure amplification property in a gun system (hereinafter "CAP gun"). Such a system is shown in the drawing FIGURE wherein a projectile, its host cartridge and a gun chamber and barrel environment are shown in a section view and indicated generally by 10.

In the FIGURE the cartridge receiver 12 is aligned in a conventional manner with the gun barrel 14. The receiver 12 includes a first counterbore 16 providing a cartridge stop ledge 20 that locates the cartridge 24 in the receiver chamber 12. The bore of the receiver chamber extends to ledge 22 which defines the inner end of the barrel portion 14. The cartridge 24 is comprised of an outer metallic housing having a first chamber containing a dielectric retaining shoulder 32. The dielectric extends from an end portion 42 extending outwardly from the outer metallic housing to a point at an innermost end 34 of the dielectric where the metallic housing has an inwardly extending projection 52.

A capillary 36 is provided in the dielectric which extends through the dielectric and provides a storage location for another dielectric, hereinafter the first dielectric, 44 as well as a first conductive means 46. The first conductive means 46 can be an anode or cathode and in a preferred embodiment is a cathode connected to an electrical power source (not shown) which in a preferred embodiment is a pulse forming network (PFN) of a conventional type. The inner end portion of the first conductive means 46 is provided with the enlarged head portion providing a shoulder 50 that contacts the dielectric 26 and prevents the first conductive means 46 from being forced out the end of the cartridge in the same way that the dielectric 26 is restrained in the outer metallic housing 24 by means of the dielectric retaining shoulder 32. The capillary 36 inboard of the end of the first conductive means 46 extends from the first conductive means 46 to and through the inwardly extending projection 52 of the metallic housing whereby an orifice or a gate means is formed by and in the inwardly extending projection. The innermost end of the capillary 36 is sealed with a membrane 54. This membrane prevents contamination from reaching the first dielectric 44 in the capillary 36.

The first chamber of the cartridge or fuel chamber thereof is a plasma generator when supplied with electrical energy from the first conductive means to the inwardly extending projection of the cartridge which is a second conductive means.

A second chamber of the cartridge is an oxidizer containing chamber or a fluid containing chamber containing energetic fluid, that is, a fluid capable of releasing energy, and being a source thereof. The energetic fluid is, in a preferred embodiment, an oxidizer means oxidizer material 56 which would be in direct communication with the first dielectric if not for the membrane 54. The energetic fluid will release its energy when it reacts with a plasma gas as explained further on.

A projectile 60 will be positioned in the barrel portion of gun and typically would abut a sealed end of the oxidizer containing chamber. Alternative embodiments are contemplated where the projectile is integral with the cartridge. The operation of the CAP gun system is initiated after loading the gun with the live cartridge and the projectile. In a preferred embodiment outer metallic housing 24, or second conductive means, is used as an anode and the first conductive means 46 is a cathode. The first dielectric 44 is a polyethylene material providing a first resistance contained in the capillary 36 between the inboard end of the first conductive means and the membrane 54. The capillary is formed in a second or additional dielectric also of polyethylene. This additional dielectric is concentrically configured inside the outer metallic housing thereby providing the capillary as shown in the drawing figure.

Although a long chain hydrocarbon polymer such as polyethylene is a preferred dielectric many electrically insulating, solid, combustible, organic or inorganic materials suit this purpose.

The oxidizer means 56 in this preferred embodiment is 70% hydrogen peroxide ($H_2O_2$) and is contained between the membrane 54 and the projectile 60. If the projectile is separate from the cartridge then a membrane will be provided to seal the end of the cartridge.

The pulse forming network (PFN), which is the power supply, is designed such that it can produce sufficient energy, in a small plasma generator on the order of 10–100 Kilovolts, to bridge the gap through the first dielectric 44 and decompose and partially ionize the first dielectric and a portion of the additional dielectric by radiant and convective heat transfer to produce a plasma which will form a plasma jet to feed a fuel of partially ionized ethylene to the oxidizer means containing chamber 56.

The plasma temperature will be greater than the temperature in the oxidizer chamber in order to ensure flow from the fuel chamber of the cartridge into the oxidizer chamber and not the other way around. In one embodiment, a plasma temperature of 10,000° K. would be desired. The hot jet of decomposed and partially ionized polyethylene fuel will be injected into the oxidizer chamber at a velocity of several thousand feet/sec. which will cause turbulent mixing of the fuel and the oxidizer creating a very large surface area which combined with the high temperature will make the reaction in the oxidizer chamber proceed instantly. The reaction can be controlled by metering the availability of fuel in the oxidizer chamber which can be accomplished by varying the geometry of the capillary, the surface area of the dielectric and the voltage across the plasma cartridge. Sonic flow through a nozzle created by the inwardly extending projections 52 forming the orifice or gate means is designed such that the mass flow rate is independent of pressure in the oxidizer chamber. It is expected that the additional dielectric 40 will be partially ablated after the first dielectric, which sublimated, depleted or otherwise discharged into the oxidizer chamber. The first dielectric may be in the form of small spheres of insulator material. The additional dielectric will be similar to the first dielectric.

The reaction of the fuel and oxidizer will generate hot pressurized gasses which expand to provide pressure to the base of the projectile to move the projectile down the barrel. The amount of electrical energy to pump the fuel, utilizing the plasma pump, is estimated to be about 10% of the overall energy of the gun thus providing, in a preferred embodiment, a ten fold pressure amplification. As the projectile moves down the barrel the additional space which becomes available can be filled by additional gases resulting in constant pressure and constant peak acceleration of the projectile if the voltage across the plasma generator and therefore the injection and combustion rates are programmed to increase with time proportionally to the volume generated by the projectile travel.

An alternative fuel, to the preferred hydrocarbon polymer, could be lithium hydride (LiH) which could be in pellet form to fill the capillary of the cartridge while an alternative oxidizer could be concentrated nitric acid or liquid oxygen (LOX). It may also be appropriate in some designs not to load the capillary with a first dielectric. In this alternative embodiment the additional dielectric will enclose the free space previously occupied by the first dielectric. An alternative structure, not shown in the drawing figure, would utilize a thin conductor or fuse from the first conductive means to the gate means area of the second conductive means. In this embodiment the capillary could be deleted (although it may be more desirable to utilize the capillary structure as a container for the first dielectric) and the additional dielectric surrounding the fuse could be such that the capillary is not present in the device. Upon electrical energization of the first conductive means a voltage would be imposed between it and the second conductor along the fuse. The metallic plasma generated by the fuse would ionize and ablate the dielectric such that a dielectric plasma is formed. The dielectric plasma would then serve as a pump means to deliver fuel to the oxidizer chamber as described above.

Thus it has been shown that a combustion augmented plasma pressure amplifier has been provided that has characteristics that make it ideal for use as a propulsion system for guns and the like. Nuances of design and variations in the details of the CAP gun embodiment specifically illustrated are contemplated by the inventors. The following claims, which are not intended to limit the scope of this invention, attempt to define the spirit of the invention.

What is claimed is:

1. A propulsive charge for use in projecting a projectile comprising:

a cartridge having a plurality of chambers including a fuel chamber from which a plasma fuel may be generated and an oxidizer chamber; said fuel chamber containing a dielectric, a first conductive means surrounded by said dielectric and an inwardly extending projection electrically communicative with said cartridge formed to provide an orifice between said fuel chamber and said oxidizer chamber, said cartridge having an outer electrically conductive body;

said oxidizer chamber adjacent said fuel chamber and communicable therewith through said orifice, said oxidizer chamber containing an oxidizer material capable of reacting chemically with said plasma fuel exhausted from said fuel chamber when said fuel is delivered to said oxidizer chamber.

2. The invention in accordance with claim 1 wherein a membrane is interposed between said fuel chamber and said oxidizer chamber.

3. The invention in accordance with claim 1 wherein said dielectric becomes a conductor upon ionization resulting from the imposition of an ionizing voltage between said first conductive means and said outer electrically conductive body of said cartridge.

4. The invention in accordance with claim 3 wherein said dielectric is a hydrcarbon polymer which in its ionized state becomes said fuel.

5. The invention in accordance with claim 4 wherein said fuel is a mixture of ionized hydrocarbon polymer plasma and hydrocarbon polymer in a condensed state.

6. The invention is accordance with claim 4 wherein said oxidizer material is hydrogen peroxide.

7. The invention in accordance with claim 4 wherein said dielectric is lithium hydride.

8. The invention in accordance with claim 3 wherein said dielectric is provided with a capillary extending from said first conductive means to said inwardly extending projection.

9. The invention in accordance with claim 8 wherein said capillary contains a first dielectric.

10. The invention in accordance with claim 8 wherein said first dielectric comprises spheres of said first dielectric.

11. The invention in accordance with claim 1 wherein said oxidizer material is hydrogen peroxide.

12. The invention in accordance with claim 1 wherein said oxidizer material is liquid oxygen.

13. In a gun system having a gun including a receiver, a barrel and a source of electrical energy, a charge containing cartridge and a projectile the cartridge comprising:

an outer metallic housing having an inwardly extending projection defining an orifice between an oxidizer storage means and a plasma fuel injector means, said outer metallic housing being a conductor means;

a dielectric carried in said plasma fuel injector means portion of said cartridge;

a first conductive means extending into said dielectric and being spaced apart from said inwardly extending projection of said outer metallic housing, said first conductive means communicating electrically with said source of electrical energy;

an energetic fluid carried in said oxidizer storage means and separated from said dielectric by membrane means;

whereby upon energization of said source of electrical energy said dielectric is ionized to a conductive state and provides a plasma jet through said orifice to deliver condensed dielectric and plasma to said energetic fluid which reacts to generate sufficient pressure to project said projectile through said barrel of said gun system.

* * * * *